US005518110A

United States Patent [19]

Harrelson

[11] Patent Number: 5,518,110

[45] Date of Patent: May 21, 1996

[54] BASKET-STYLE CARRIER WITH END PANEL LOCK

[75] Inventor: Glen R. Harrelson, Atlanta, Ga.

[73] Assignee: Riverwood International Corporation, Atlanta, Calif.

[21] Appl. No.: 501,347

[22] Filed: Jul. 12, 1995

[51] Int. Cl.[6] ..... B65D 5/10

[52] U.S. Cl. ..... 206/139; 206/170; 206/193; 206/200; 206/427

[58] Field of Search ..... 206/139–140, 206/144, 147, 170, 171, 174, 198, 175, 193, 194, 200, 427

[56] References Cited

U.S. PATENT DOCUMENTS

| | | | |
|---|---|---|---|
| 2,225,822 | 12/1940 | Crook | 206/198 |
| 2,304,683 | 12/1942 | Finn et al. | 206/198 |
| 3,119,515 | 1/1964 | Kursh | 206/198 |
| 3,204,815 | 9/1965 | Weiss | 206/171 |
| 4,049,189 | 9/1977 | Wood | 206/427 |
| 4,402,400 | 9/1983 | Stout | 206/193 |
| 4,433,807 | 2/1984 | Ganz | 206/139 |
| 5,069,335 | 12/1991 | Beales | 206/144 |
| 5,423,420 | 6/1995 | Bakx | 206/139 |

FOREIGN PATENT DOCUMENTS

| | | | |
|---|---|---|---|
| 582408 | 2/1994 | United Kingdom | 206/198 |

*Primary Examiner*—Paul T. Sewell
*Assistant Examiner*—Luan K. Bui

[57] ABSTRACT

A basket-style carrier constructed so as to maintain the carrier open during loading. One of the sections forming an end panel of the carrier includes a retaining tab extending across an opening in the adjacent end panel section. This prevents the end panel from collapsing about the fold lines connecting the end panel sections to the handle panel support structure during loading. The opening extends into the adjacent handle panel support structure, allowing the retaining tab to freely move through the opening in the support structure as the carrier is opened from collapsed condition.

16 Claims, 3 Drawing Sheets

BASKET-STYLE CARRIER WITH END PANEL LOCK

FIELD OF THE INVENTION

This invention relates to a basket-style carrier for carrying articles such as beverage bottles. More particularly, it relates to a basket-style carrier capable of maintaining an open square condition during loading of bottles or other articles.

BACKGROUND OF THE INVENTION

Basket-style carriers are commonly employed to package beverage bottles. A conventional arrangement includes a separate cell for each bottle and a center handle partition. The carriers are fabricated from a blank which is folded and glued into collapsed carrier form, after which the collapsed carrier is erected. In one design the bottom panel is integrally formed so that when the collapsed carrier is erected bottles may be inserted down onto the bottom panel through the open cells. In another design the bottom panel is formed by connecting bottom panel flaps after the bottles have been inserted into the cells. The bottles are commonly inserted in this latter design by moving an opened carrier down over a group of stationary bottles, although the bottles may also be inserted by moving them down into the opened carrier.

In either case, in order to insert the bottles prior to forming the bottom panel the collapsed carrier must not only be opened to a square condition to allow entry of the bottles into the appropriate cells but must be maintained in this condition until relative movement of the bottles into the carrier progresses to the point where the bottles themselves prevent collapsing of the carrier. This is necessary because the end panels of a typical basket-style carrier include a vertical fold line aligned with the handle panel, which allows the end panels to be folded into collapsed condition. These end panel segments tend to fold back toward their original position after being initially opened, which misaligns the cells and bottles. To counter this tendency, elements of the packaging machine have been designed to initially maintain the carrier in open condition until the bottles are inserted to the point where they are able to hold the carrier open. This complicates the design of the packaging machine, however, and can be a limitation on the speed of the machine.

It would be highly desirable to be able to maintain the erected carrier in open condition by means other than by packaging machine elements without complicating the carrier design or making it more expensive.

BRIEF SUMMARY OF THE INVENTION

The invention applies to basket-style article carriers of the type having end panels which are comprised of two end panel sections, each end panel section being foldably connected to a side panel and to one of the plies of a two-ply handle panel support element. One of the end panel sections of one of the end panels includes a retaining tab which extends transversely beyond the handle panel support fold line of the end panel section. The adjacent end panel section has an opening extending outwardly of its handle panel support fold line. The retaining tab extends across the opening and overlaps the outer edge of the opening, which prevents the end panel sections from collapsing about the handle panel support fold lines.

In a preferred arrangement the retaining tab in the end panel section is cut out from the associated ply of the handle panel support means and the opening in the adjacent end panel section is a continuation of an opening in the associated ply of the handle panel support means. This arrangement allows the retaining tab to move into operative position without interference from adjacent structure.

The carrier is formed from a blank which consists of two substantially identical half-blank portions. Each half-blank portion is laid out so that inner and outer handle panel sections are connected to each other, and end panel sections are connected to a side panel section and to handle panel support flaps. One of the handle panel support flaps of each half-blank portion is connected to the outer handle panel section. The other handle panel support flap includes the locking opening while the corresponding handle panel support section of the other half-blank portion includes retaining tab forming slits.

In addition, in a preferred arrangement a bottom panel forming flap at each end of the carrier is adhered to the bottom panel to tighten the connection between the side, end and bottom panels. As described in more detail below, the flaps may be provided on one of the end panel sections which form the end panels.

These and other features and aspects of the invention will be readily ascertained from the detailed description of the preferred embodiments described below.

DETAILED DESCRIPTION OF THE PREFERRED EMBODIMENT

Figure 1:
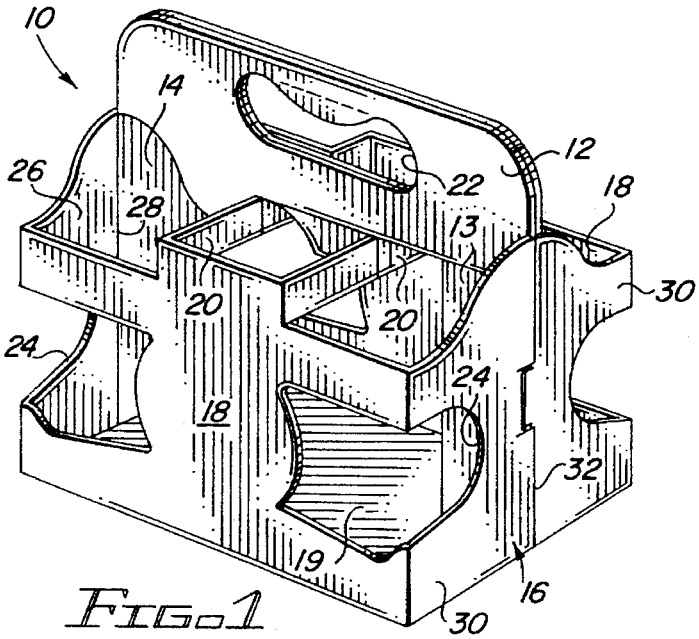
FIG. 1 is a pictorial view of a basket-style carrier incorporating the anti-collapsing features of the invention.

Referring to FIG. 1, the basket-style carrier 10 of the invention includes a central handle panel 12 connected to riser panels 13 and 14 which in turn are connected to end panels 16. The end panels are connected to side panels 18, and the side panels are connected to a bottom panel 19. Individual cells for receiving bottles or other articles are formed by straps 20 which extend from the side panels 18 to the handle panel 12. The handle panel includes a handle opening 22 and the carrier further includes corner cutouts 24 which extend into the adjacent side and end panels. This construction allows substantial portions of the end bottles in the carrier to be viewed, which is advantageous where the shape of the bottles contributes to brand identification.

Each end panel 16 is formed from two end panel sections which are connected by fold lines to the adjacent riser panel 13 or 14. In the end panel facing away from the viewer, end panel sections 26 are connected to the riser panel 14 by fold lines 28. In the end panel facing the viewer, end panel sections 30 are connected to the riser panel 13 by fold lines 32. The fold lines 32 are interrupted by a tab on one of the end panel sections 30 and a cutout in the other end panel section 30. This arrangement allows the carrier to remain open during loading as explained in more detail below.

Figure 2:
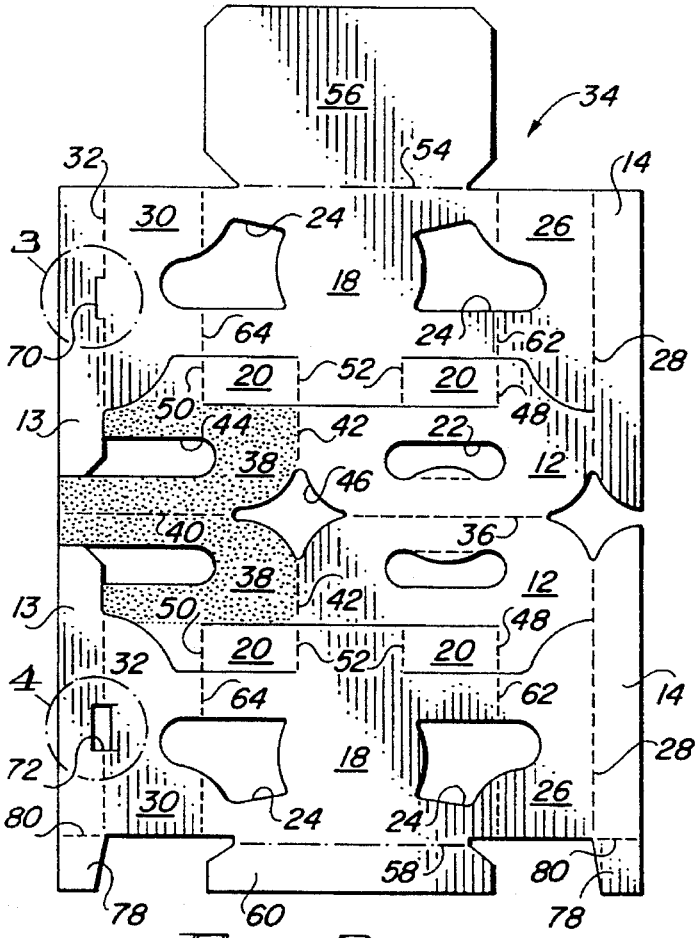
FIG. 2 is a plan view of a blank for fabricating the carrier.

Referring to FIG. 2, wherein like reference numerals to those used in FIG. 1 denote like elements, a blank 34 for forming the carrier is shown as being of generally rectangular shape except for an outwardly extending bottom panel flap. Preferably, the blank is formed from paperboard of the type conventionally used in the carrier industry. Centrally located at the right side of the blank are two similar outer handle panel sections 12 connected together by a central fold line 36. Immediately to the left of the panel sections 12 are two similar inner handle panel sections 38, which are connected to each other by central fold line 40 and to the panel sections 12 by fold line 42. Cutouts 44 in the inner handle panel sections are aligned with the handle cutouts 22 in a carrier formed from the blank, and the fold line 40 is an extension of the fold line 36. Cutout 46 at the ends of the fold line 36 facilitate folding and determine the shape of the handle panel corners.

The outer ends of the straps 20 at the right of the blank are connected to the outer handle panel sections 12 by fold lines 48 while the outer ends of the straps at the left of the blank are connected to the inner handle panel sections 38 by fold lines 50. The inner ends of the straps are connected to the side panel sections 18 by fold lines 52. One of the side panel sections 18 is connected along fold line 54 to bottom panel flap 56, and the other side panel section is connected along fold line 58 to glue flap 60. The side panel sections 18 are connected by fold lines 62 to end panel sections 26, which in turn are connected along fold lines 28 to riser panel flaps 14. Similarly, the side panel sections are connected at their opposite ends by fold lines 64 to end panel sections 30, which in turn are connected along fold lines 32 to riser panel flaps 13. Other than the edges of the handle panel sections formed by the cutout 46 and by fold lines 36, 40 42 and 28, the edges of the handle panel sections are formed by slits separating the handle panel sections from the cell divider straps and from the side and end panel sections, producing free edges when the blank is formed into a carrier.

Figure 4:
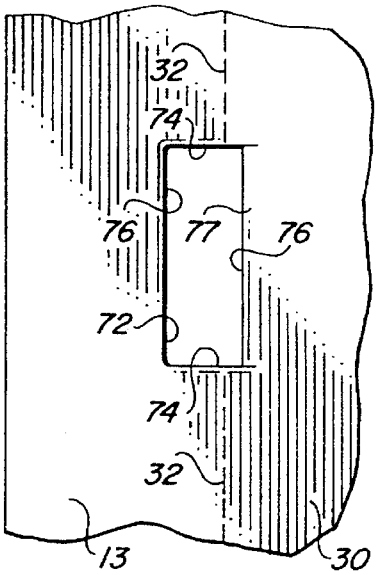
FIG. 4 is an enlarged partial plan view of the portion of the blank within the circle 4—4 of FIG. 2.
Figure 3:
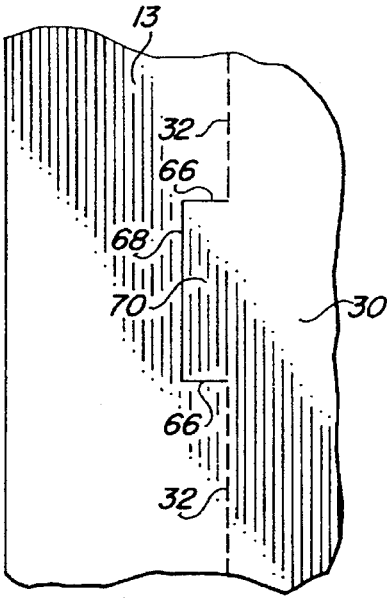
FIG. 3 is an enlarged partial plan view of the portion of the blank within the circle 3—3 of FIG. 2.

The carrier blank described thus far is typical of one form of blank for forming a basket-style carrier whose cells are separated by straps. In accordance with the invention, as shown in greater detail in FIG. 3 the fold line 32 of one of the riser panel flaps 13 is interrupted by spaced transverse slits 66 which are connected by slit 68 to form a retainer locking tab 70. As shown in greater detail in FIG. 4 the fold line 32 of the other riser panel flap 13 is interrupted by a retainer locking opening 72 defined by spaced transverse edges 74 connected by spaced edges 76. The opening extends into both the riser panel flap 13 and the end panel section 30, and the slits 74 extend beyond the edge 76 in the end panel section 30 for a short distance to form a short tab 77 at the end of the opening. In addition, as shown in FIG. 2, bottom panel forming tabs 78 are connected by fold lines 80 at the lower ends of the riser panel flaps 13 and 14.

Still referring to FIG. 2, to form a carrier from the blank the inner handle panel sections 38 are coated with adhesive, as shown in stipple, and are then pivoted about fold line 42 onto the outer handle panel sections 12. This results in the interim form of blank illustrated in FIG. 5, in which the handle panel sections are adhered together. The next step is to apply adhesive to the areas of the riser panel flaps 13 shown in stipple in FIG. 5, and then fold the end panel sections 30 about the fold lines 64. At this time the riser panel flaps 14 are also folded in about the fold lines 28. These steps adhere the riser panel flaps 13 to the inner handle panel sections 38 and produce the interim form of blank shown in FIG. 6.

Figures 5, 6, 7:
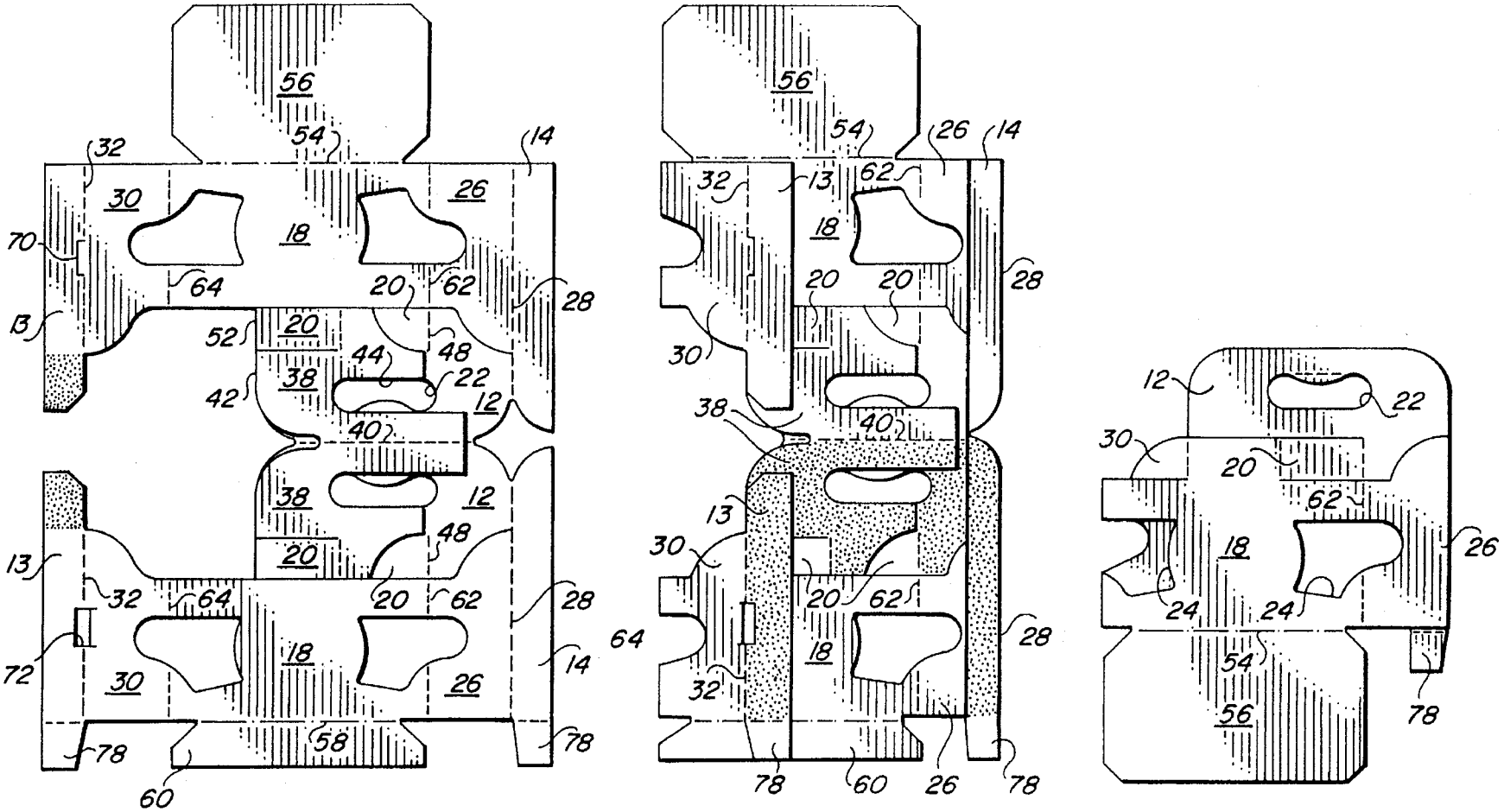
FIG. 5 is a plan view of the carrier blank after an initial folding and gluing step.
FIG. 6 is a plan view of the carrier blank after further folding and gluing steps.
FIG. 7 is a plan view of a collapsed carrier resulting from final folding and gluing steps.

The final sequence of the forming operation is to apply adhesive to the stippled areas of the folded riser panel flaps 13 and 14 and of the inner and outer handle panel section 34 and 12, as shown in FIG. 6, and to then fold the blank about the central fold lines 36 and 40. This produces the collapsed carrier illustrated in FIG. 7, in which the end panels formed from the end panel sections 26 extend out from the side panels 18 in folded condition and the end panels formed from the end panel sections 30 are inwardly folded between the side panels. The forming tabs 78 and the bottom panel flap 56 are still in unfolded condition at this point.

Figure 8:
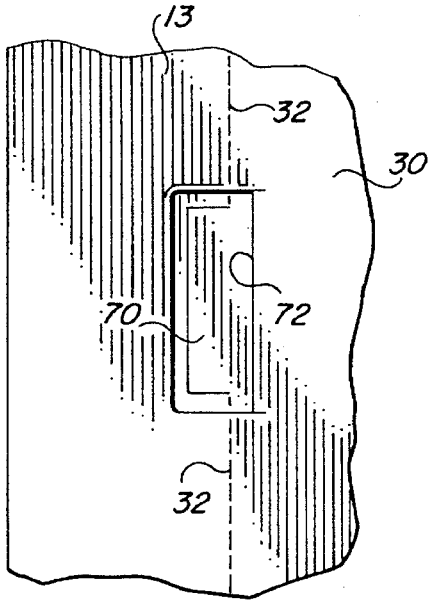
FIG. 8 is an enlarged partial plan view of the panel section of the collapsed carrier containing the locking opening.

FIG. 8 illustrates the relationship between the retainer tab 70 and the locking opening 72 in the collapsed carrier. As can be seen, the pair of end panel sections 30 and the pair of riser panel flaps 13 are in face-to-face relationship at this point, with the locking opening 72 overlying the tab 70. This shows that the opening is slightly larger than the tab in order to permit free movement of the tab through the opening as the carrier is opened.

Figure 9:
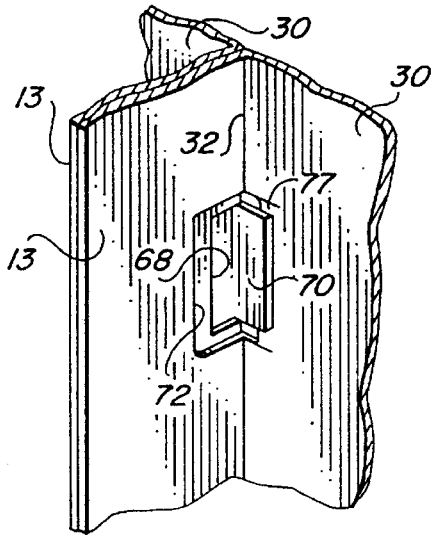
FIG. 9 is an enlarged partial pictorial view of the inner face of the end panel as the carrier is being opened, showing the relationship of the retainer locking tab and the locking opening.
Figure 11:
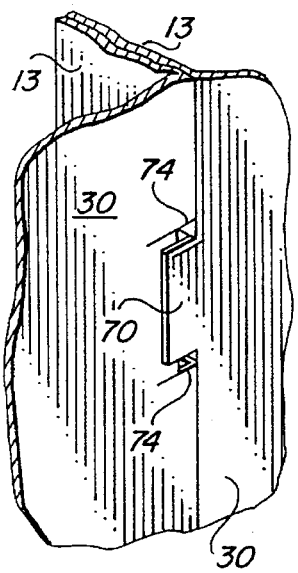
FIG. 11 is an enlarged partial pictorial view of the portion of the end panel of the erected carrier within the circle 11—11 of FIG. 10.
Figure 10:
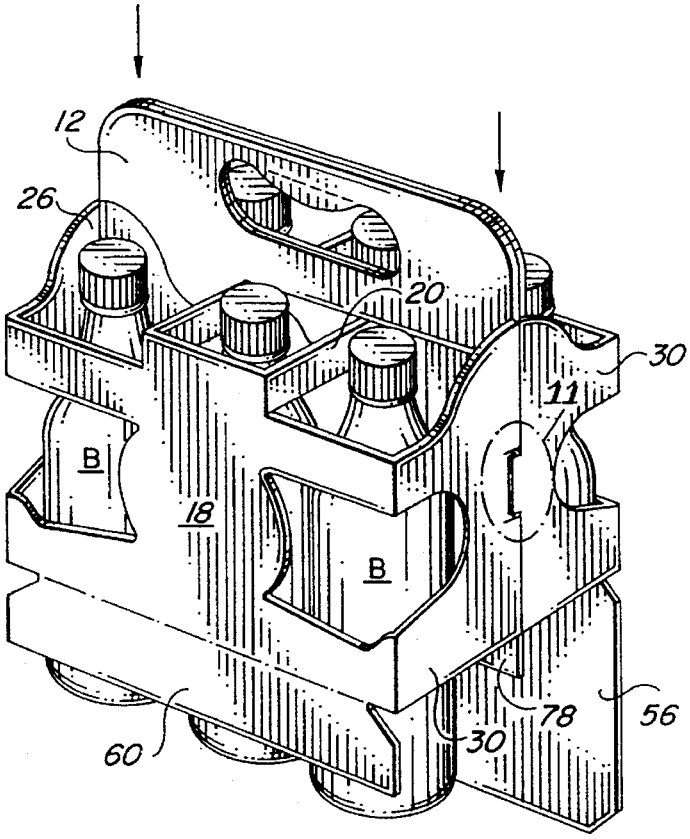
FIG. 10 is a pictorial view of an erected carrier in the process of being moved down over a group of bottles.

To form a loaded carrier from the collapsed carrier of FIG. 7, the collapsed carrier is squared up by pressing the outer ends of the outwardly extending end panel sections toward the opposite end, as is well known in the industry. As the end panel sections at each end of the carrier move from their face-to-face relationship to their final end-to-end positions, the tab 70 moves through the opening 72 until it reaches the point illustrated in FIG. 9, which shows the tab 70 in contact with the inner face of the other end panel section 30. As the squaring-up force is further applied, the tab 70 pushes against the tab 77 of the locking opening with sufficient force to cause the tab 77 to flex back enough to allow the locking tab 70 to pass through the portion of the opening in the end panel section 30. This relationship is illustrated in FIGS. 10 and 11. As can be understood, when the carrier opening force is withdrawn, the tab 70, now on the outside of the carrier, is biased by the folds 28 and 32 back toward its position in the collapsed state of the carrier. This biasing force, however, is not sufficient to move the locking tab 70 back past the locking opening tab 77, with the result that the engagement of the tab 70 with the tab 77 prevents the carrier from collapsing.

As shown in FIG. 10, the opened carrier is aligned with a group of bottles B to be packaged and is then lowered down over them. Since the locking tab 70 maintains the carrier in open condition, there is no need to provide the packaging machine with movable elements to hold the carrier open. During this step the bottom panel flap 56 and the bottom panel forming flaps 78 remain unfolded. After the carrier reaches it final position relative to the bottles, the forming flaps 78 are folded in to bring them up against the bottoms of the bottles. The bottom panel flap 56 and the glue flap 60 are then folded and adhered to each other and to the forming flaps 78, as by glue, to form the bottom panel of the carrier. Of course the carrier could be opened as described and bottles loaded into it by lowering them down into the cells instead of lowering the carrier down over the bottles.

In either case the locking means of the invention causes the carrier to remain open, eliminating the risk of a collapsing carrier interfering with the loading process.

The provision of the bottom panel forming flaps 78 enables the carrier to be more tightly formed about the bottles about the bottles. As a result of the bottom panel flap being adhered to the forming flaps, the side panels, by virtue of their integral connection to the bottom panel flap, and the end panels, by virtue of their integral connection to the bottom panel forming flaps, are directly linked to the bottom panel. Thus the side panels, the end panels and the bottom panel are locked into place as a unit after the bottom panel flaps and the bottom panel forming flaps are moved into place, causing the bottles about which the bottom panel is formed to be tightly held in place.

It will be apparent that although the invention has been described in connection with a carrier designed for holding bottles, it applies equally as well to carriers designed to hold other types of articles instead. It is contemplated that the invention need not necessarily be limited to all the specific details described in connection with the preferred embodiments, but that changes to certain features of the preferred embodiment which do not alter the overall basic function and concept of the invention may be made without departing from the spirit and scope of the invention defined in the appended claims.

What is claimed is:

1. A basket-style article carrier, comprising:

opposite side panels connected to a bottom panel;

a centrally located handle panel;

means for supporting the handle panel, said support means being of two-ply construction and extending downwardly from and lying in substantially the same plane as the handle panel;

opposite end panels connected to the side panels, each end panel being comprised of two end panel sections, each end panel section being foldably connected to one of the opposite side panels;

each end panel section being connected to one of the plies of the handle panel support means along a handle panel support fold line;

one of the end panel sections of one of the end panels having a retaining tab extending transversely beyond the handle panel support fold line thereof;

the other end panel section of said one end panel having an opening extending outwardly of the handle panel support fold line thereof, the opening having an outer edge spaced from said handle panel support fold line;

the retaining tab extending across the opening and overlapping the outer edge of the opening, whereby the end panels formed from the end panel sections are prevented from collapsing about the handle panel support fold lines.

2. A basket-style article carrier as defined in claim 1, wherein the ply of the handle panel support means to which said one end panel section is connected includes a cutout from which the retaining tab was formed, and the ply of the handle panel support means to which said other end panel section is connected includes an opening aligned with the cutout, said opening being a continuation of the opening in said other end panel section.

3. A basket-style article carrier as defined in claim 2, wherein the opening in the handle panel support means to which said other end panel section is connected is larger than the cutout from which the retaining tab was formed, the retaining tab thereby being able to freely move through the cutout as the carrier is opened from a collapsed state in which said one end panel section is in face-to-face relationship with said other end panel section.

4. A basket-style article carrier as defined in claim 2, wherein said other end panel section includes spaced slits extending outwardly from the outer edge of the opening to form a second tab, the retaining tab overlying at least a portion of the second tab.

5. A basket-style article carrier as defined in claim 1, including at least one partition extending from each of the side panels to divide the carrier into article-receiving cells.

6. A basket-style article carrier as defined in claim 1, wherein the handle panel support means comprises a riser panel at each end of the carrier.

7. A basket-style article carrier as defined in claim 1, including a bottom panel forming flap connected along a fold line to one of the end panel sections of each end panel, the bottom panel forming flaps being adhered to the bottom panel.

8. A collapsed basket-style article carrier, comprising:

opposite side panels having end edges;

a bottom panel flap connected to at least one of the side panels;

an end panel section connected to each end edge of each side panel along a fold line, a centrally located handle panel;

means for supporting the handle panel, said support means being of two-ply construction and extending downwardly from and lying in substantially the same plane as the handle panel;

each end panel section being connected to one of the plies of the handle panel support means along a handle panel support fold line;

the end panel sections at one end of the collapsed carrier being inwardly folded so that the inner faces of said end panel sections are adjacent the handle panel support means and the end panel sections at the other end of the collapsed carrier being outwardly folded so that the outer faces of said end panel sections are adjacent each other, said end panel sections lying in substantially the same plane as the associated plies of the handle panel support means;

one of the end panel sections at said other end of the collapsed carrier having a retaining tab formed by slits in the associated ply of the handle panel support means;

the other end panel section at said other end of the collapsed carrier including an opening extending into the associated ply of the handle panel support means;

the opening overlying and being larger than the retaining tab, the retaining tab thereby being able to freely move through the cutout as the collapsed carrier is opened so as to extend across the opening in the other end panel section of the opened carrier to prevent the opened carrier from collapsing about the handle panel support fold lines.

9. A collapsed basket-style article carrier as defined in claim 8, wherein said other end panel section includes spaced slits extending from the opening therein, the spaced slits forming a second tab, the retaining tab overlying at least a portion of the second tab after the collapsed carrier has been opened.

10. A collapsed basket-style article carrier as defined in claim 8, wherein the handle panel support means comprises a riser panel at each end of the carrier.

11. A collapsed basket-style article carrier as defined in claim 8, including a bottom panel forming flap connected along a fold line to one of the end panel sections of each end panel, the bottom panel forming flaps being adhered to the bottom panel of a carrier formed from the collapsed carrier.

12. A blank for forming a basket-style carrier, comprising:

two substantially identical half-blank portions;

each half-blank portion including an outer handle panel section connected to the outer handle panel section of the other half-blank portion by a central fold line;

each outer handle panel section having opposite end edges extending substantially at right angles to the central fold line and a lower edge extending transversely of the end edges;

an inner handle panel section connected by a fold line to one of the end edges of each of the outer handle panel sections;

a first handle panel support flap connected by fold line to the opposite end edge of each of the outer handle panel sections;

a first end panel section located beneath a portion of each of the outer handle panel sections and being connected by fold line to the associated first handle panel support flap;

a side panel section located beneath portions of each of the outer handle panel sections and the associated inner handle panel section, each side panel section being connected by a first fold line to the associated first end panel section;

a second end panel section located beneath a portion of each of the inner handle panel sections and being connected by a second fold line to the associated side panel section;

a second handle panel support flap connected by fold line to each second end panel section;

a bottom panel flap connected by fold line to the side panel section of at least one of the half-blank portions;

one of the second end panel sections having a retaining tab formed by slits in the associated ply of the handle panel support flap; and the other second end panel section including an opening extending into the associated ply of the handle panel support flap, the opening being larger than the retaining tab and being located so that the retaining tab extends across the opening in the second end panel section of a carrier formed from the blank to prevent the carrier from collapsing about the handle panel support fold lines.

13. A carrier blank as defined in claim 12, wherein said other second end panel section includes spaced slits extending from the opening therein, the spaced slits forming a second tab, the retaining tab overlying at least a portion of the second tab in a carrier formed from the blank.

14. A carrier blank as defined in claim 12, wherein one of the end panel sections of each half-blank portion includes a bottom panel forming flap extending away from the central fold line.

15. A carrier blank as defined in claim 14, wherein each bottom panel forming flap is connected by a fold line to the associated first end panel section.

16. A carrier blank as defined in claim 12, including a cell divider foldably connected to each half-blank portion.

* * * * *